US008936088B2

(12) United States Patent
Misselbrook et al.

(10) Patent No.: US 8,936,088 B2
(45) Date of Patent: Jan. 20, 2015

(54) CUTTING ASSEMBLY AND METHOD OF CUTTING COILED TUBING

(75) Inventors: John Misselbrook, Calgary (CA); Manfred Sach, Sola (NO); Jason Skufca, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 700 days.

(21) Appl. No.: 13/247,757

(22) Filed: Sep. 28, 2011

(65) Prior Publication Data

US 2012/0018158 A1 Jan. 26, 2012

Related U.S. Application Data

(63) Continuation-in-part of application No. 12/784,311, filed on May 20, 2010, now Pat. No. 8,459,358.

(51) Int. Cl.
*E21B 29/00* (2006.01)
*E21B 43/11* (2006.01)

(52) U.S. Cl.
CPC ..... *E21B 29/00* (2013.01)
USPC ..... 166/298; 166/55.7

(58) Field of Classification Search
USPC ..... 166/298, 54.5, 55, 55.1, 55.2, 55.3, 166/55.6, 55.7, 55.8, 170, 173, 297
See application file for complete search history.

(56) References Cited

U.S. PATENT DOCUMENTS 2,880,804 A * 4/1959 Fredd ..... 166/55.8
3,649,032 A 3/1972 Nelson
4,134,453 A * 1/1979 Love et al. ..... 166/298
4,345,646 A 8/1982 Terrell
4,373,380 A 2/1983 Mayo
4,619,318 A * 10/1986 Terrell et al. ..... 166/55
4,971,146 A 11/1990 Terrell
5,509,480 A 4/1996 Terrell et al.
5,526,888 A 6/1996 Gazewood
5,575,331 A * 11/1996 Terrell ..... 166/55
5,924,489 A 7/1999 Hatcher
6,564,868 B1 5/2003 Ferguson
7,296,597 B1 11/2007 Freyer et al.

(Continued)

FOREIGN PATENT DOCUMENTS

GB 2371575 A 6/2003
WO WO9954590 10/1999

OTHER PUBLICATIONS

Enoil, "Pigs & Darts for Coiled Tubing," 3 pages, Apr. 26, 2010, Publisher: http://www.benoil.com/darts/pig.htm.

(Continued)

*Primary Examiner* — Kenneth L Thompson
*Assistant Examiner* — Michael Wills, III
(74) *Attorney, Agent, or Firm* — Parsons Behle & Latimer

(57) ABSTRACT

A coiled tubing cutter assembly comprises a housing configured to be inserted in a length of coiled tubing. The housing forms a main bore and a first pathway through which cutting fluid can flow through the housing and be directed to impinge against an inner surface of the coiled tubing over which the housing is positioned so as to cut the coiled tubing. A sleeve is positioned in the main bore. The sleeve is movable between a first position and a second position within the main bore. The sleeve is configured so as to block the first pathway when in the first position and to allow cutting fluid to pass through the first pathway in the second position. A method of cutting coiled tubing is also disclosed.

19 Claims, 6 Drawing Sheets

(56) References Cited

U.S. PATENT DOCUMENTS

| | | | | |
|---|---|---|---|---|
| 7,452,161 | B2 | 11/2008 | Freyer et al. | |
| 7,562,909 | B2 | 7/2009 | Luft et al. | |
| 7,628,205 | B2 * | 12/2009 | Fuhst et al. | 166/298 |
| 8,020,619 | B1 * | 9/2011 | Robertson et al. | 166/297 |
| 2004/0231836 | A1 * | 11/2004 | Budde | 166/75.15 |
| 2006/0011344 | A1 * | 1/2006 | Lynde et al. | 166/298 |
| 2008/0185137 | A1 | 8/2008 | Palmer | |
| 2008/0308269 | A1 * | 12/2008 | D'Amico | 166/170 |
| 2009/0025938 | A1 * | 1/2009 | Tveiten et al. | 166/351 |
| 2009/0288833 | A1 | 11/2009 | Graham et al. | |
| 2010/0059228 | A1 | 3/2010 | Jones et al. | |
| 2010/0071912 | A1 | 3/2010 | Mackenzie | |
| 2012/0211245 | A1 * | 8/2012 | Fuhst et al. | 166/382 |

OTHER PUBLICATIONS

Wikipedia, "Carbide", May 20, 2010, pp. 1-5, Publisher: http://en.wikipedia.org/wiki/Carbide.

Weatherford International Ltd., "Internal Dimple Connector, Thru-Tubing Intervention; 2 pages,", Jan. 1, 2006.

Weatherford International Ltd., "CT Dimple-On Connector, Flow Controls" 1 page, Jan. 1, 2002.

Office Action dated Oct. 9, 2012 issued in U.S. Appl. No. 12/784,311.

International Search Report and Written Opinion dated Oct. 8, 2012 issued in PCT/US2011/034468.

International Search Report and Written Opinion dated Oct. 31, 2012 issued in PCT/US2012/053665.

* cited by examiner

CUTTING ASSEMBLY AND METHOD OF CUTTING COILED TUBING

This application is a continuation-in-part of U.S. patent application Ser. No. 12/784,311, filed May 20, 2010, now U.S. Pat. No. 8,459,358, the disclosure of which is hereby incorporated by reference in its entirety.

FIELD OF THE DISCLOSURE

The present disclosure relates generally to a cutting assembly and a method of cutting coiled tubing.

BACKGROUND

Coiled tubing is used in maintenance tasks on completed oil and gas wells and drilling of new wells. End connectors can be used to attach tools, such as a drill motor with bit, jetting nozzles, packers, etc, to the end of the coiled tubing. The tools can then be run into the well and operated on the coiled tubing.

There are two basic types of end connectors for coiled tubing: internal connectors, such as dimple connectors; and external connectors, such as grapple connectors. Internal connectors include a shaft that fits inside the end of the coiled tubing. The coiled tubing can then be crimped to provide a dimpled profile for the pipe and the internal shaft so that the connector grips tight and will not come off the coiled tubing.

External connectors are often used for deploying tools into wells. External connectors include, for example, "grapple connectors" or "slip connectors". They have an external housing that contains profiled segments with teeth that bite into the outside of coiled tubing, thereby holding the external connector in place on the coiled tubing. One grapple connector is known to include both an outer housing and an inner sleeve. The inner sleeve supports the coiled tubing and allows the teeth of the outer housing to bite more firmly into the end of the coiled tubing when the outer sleeve is tightened around the end of the coiled tubing, thereby improving the connection between coiled tubing and connector. This grapple connector is made by BJ Services Company LLC, and is marketed under the name GRAPPLE FM CONNECTOR™.

When running a tool attached to coiled tubing via internal or external connectors, there is a risk that the tool will get stuck in the well. To address this problem, coiled tubing downhole tool assemblies that have a diameter greater than that of the coiled tubing often include a hydraulic disconnect. The hydraulic disconnect is attached between the end connector and the tool and includes a piston held in place by a shear pin. In the event the tool becomes stuck, a ball can be pumped down through the coiled tubing and into the hydraulic disconnect. The ball lands on a ball seat of the piston thereby blocking flow through the coiled tubing. Sufficient hydraulic pressure can then be applied to sheer the sheer pin, allowing the piston to slide down and disengage the 'dogs' holding the tool together with the result that the tool disconnects from the coiled tubing.

However, in some cases the coiled tubing remains stuck after disconnecting the tool. For example, this can occur where the coiled tubing is hung up in the well at the end connector. A solution for this problem is to kill the well and cut the coiled tubing on surface. A severing tool can then be run from the surface through the coiled tubing on electric line. The severing tool can be, for example, a plasma cutting tool or a shaped explosive charge, which is used to cut the coiled tubing above the end connector, thereby freeing the coiled tubing. However, this solution is problematic for several reasons. Killing the well can potentially cause damage to the well, is time consuming, and results in lost production until the well is brought back on stream. Further, cutting the coiled tubing string at the surface can potentially render the string too short to be reused in the well, thereby requiring deployment of a new tubing string, which can be costly.

Other devices that are generally well known in the art for use in coiled tubing include pigs and darts. Pigs and darts can be pumped through the coiled tubing to accomplish, for example, the cleaning of unwanted debris from inside of the coiled tubing. Darts are sometimes used during well completions when pumping cement. After the cement is pumped into well through the coiled tubing, a dart can be inserted and then water can be employed to hydraulically push the dart and cement to displace the cement out of the coil. It is well known that the dart can include a frangible disc positioned in a flowpath through the center of the dart. It is also well known that a polyurethane fin or seal can be positioned around the outer circumference of the dart. After displacing the cement, the pig/dart lands on an internal connector positioned at the end of the coiled tubing and seals off any further flow. The coiled tubing can then be pulled free from the cement without fear that displacement fluid might contaminate the cement slurry. Subsequently the coiled tubing can be pressured up sufficiently to burst the frangible disc and thereby reestablish flow through the coiled tubing. However pigs and darts are not known for use in solving the problem of a coiled tubing tool assembly stuck in a well.

Using sand slurries for erosive perforating and/or slotting of well casing is well known in the art. Typically the sand slurry can be water with approximately 5% by volume of sand. The sand slurry base fluid, which is water, can preferably have a light loading of gelling agent to help suspend the sand in the surface mixing apparatus and provide fluid friction pressure reduction when pumping the sand slurry into the well. Alternatively, a conventional friction reducer and surface mixing equipment can be used in place of the gel.

The cutting darts and other cutting assemblies and methods of the present disclosure may reduce or eliminate one or more of the problems discussed above.

SUMMARY

An embodiment of the present disclosure is directed to a cutting dart. The cutting dart comprises a dart body including a first pathway. The first pathway is configured to redirect cutting fluid flowing through a coiled tubing so that the cutting fluid flows radially to impinge against an inner surface of the coiled tubing. A seal is positioned around an outer circumference of the dart body.

Another embodiment of the present disclosure is directed to a method of cutting a coiled tubing string in a well bore. The method comprises pumping a cutting dart through a coiled tubing until it lands at a location proximate the position at which the coiled tubing is to be cut. Cutting fluid can then be pumped through the cutting dart so that the cutting fluid is redirected radially against an inner diameter of the coiled tubing so as to cut the coiled tubing. The coiled tubing can then be retrieved from the well bore.

Yet another embodiment of the present disclosure is directed to a coiled tubing assembly. The coiled tubing assembly comprises a coiled tubing string including a proximal end at a surface location and a distal end positioned in a well bore. A cutting dart is positioned in the coiled tubing string. The cutting dart comprises a dart body comprising a first pathway configured to redirect cutting fluid flowing through the coiled tubing so that the cutting fluid flows radially to impinge against an inner surface of the coiled tubing. A seal is positioned around an outer circumference of the dart body.

Still another embodiment of the present disclosure is directed to an anchor dart. The anchor dart comprises a dart body. A swellable elastomer is positioned around an outer circumference of the dart body.

Another embodiment of the present disclosure is directed to a method of isolating a portion of a coiled tubing string. The method comprises pumping an anchor dart through a coiled tubing until it is positioned at a location at which the coiled tubing is to be isolated. A swellable elastomer can then be expanded to fix the anchor dart inside the coiled tubing and thereby inhibiting the flow of fluid through the coiled tubing.

Still another embodiment of the present disclosure is directed to a coiled tubing cutter assembly. The coiled tubing cutter assembly comprises a housing configured to be inserted in a length of coiled tubing. The housing forms a main bore and a first pathway through which cutting fluid can flow through the housing and be directed to impinge against an inner surface of the coiled tubing over which the housing is positioned so as to cut the coiled tubing. A sleeve is positioned in the main bore. The sleeve is movable between a first position and a second position within the main bore. The sleeve is configured so as to block the first pathway when in the first position and to allow cutting fluid to pass through the first pathway in the second position.

Yet another embodiment of the present disclosure is directed to a method of cutting a coiled tubing in a well bore. The method comprises establishing an open flowpath proximate a desired cut site for directing cutting fluid against an inner surface of the coiled tubing. Cutting fluid is pumped through the open flowpath so that the cutting fluid impinges against the cut site so as to cut the coiled tubing. A first portion of coiled tubing above the cut site is retrieved from the well bore while a second portion of the coiled tubing below the cut site remains in the well.

Another embodiment of the present disclosure is directed to a coiled tubing assembly. The coiled tubing assembly comprises a length of coiled tubing positioned in a well bore. A coiled tubing cutter assembly is positioned in the coiled tubing. The cutter assembly comprises a housing configured to be inserted in the coiled tubing. The housing forms a main bore and a first pathway through which cutting fluid can flow through the housing and be directed to impinge against an inner surface of the coiled tubing so as to cut the coiled tubing. A sleeve is positioned in the main bore. The sleeve is movable between a first position and a second position within the main bore. The sleeve is configured so as to block the first pathway when in the first position and to allow cutting fluid to pass through the first pathway when in the second position.

Figure 1:
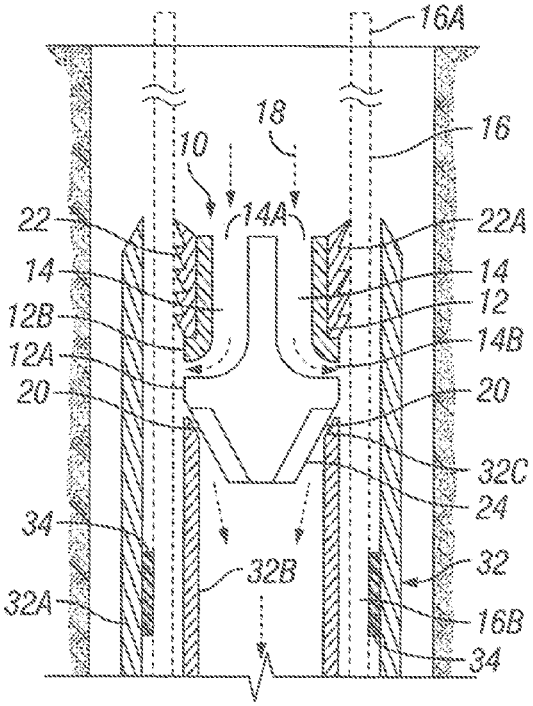
FIG. 1 illustrates a cutting dart, according to an embodiment of the present disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

FIG. 1 illustrates a cutting dart 10, according to an embodiment of the present disclosure. The cutting dart 10 includes a dart body 12 with a first pathway 14 positioned there through. The cutting dart 10 can be positioned in coiled tubing 16. By redirecting cutting fluid flowing through the coiled tubing 16 so that the cutting fluid impinges against an inner surface of the coiled tubing 16, the coiled tubing 16 can be severed. As will be described in greater detail below, this can be useful for releasing coiled tubing that is hung up in a well bore.

The dart body 12 can include an inner body portion 12A and an outer body portion 12B. The profiles of the inner body portion 12A and outer body portion 12B can be shaped in any manner that will redirect the cutting fluid flow, as desired. For example, the inner body portion 12A can have a trumpet shaped profile. Inner body portion 12A and outer body portion 12B can be connected in any suitable manner, such as with ribs (not shown) extending between them. The dart body 12 can be made of any material that will resist erosion long enough to endure the passage of erosive slurry for the relatively short time required to execute the cut. For example, this could be steel stainless steel or other materials. The inner body portion 12A and outer body portion 12B can be made of different materials. In an embodiment, the inner body portion 12A can be made of materials that have increased resistance to erosion. This is because the inner body portion 12A may experience slightly higher erosion as the cutting fluid is directed radially away from the cutting dart versus the outer body 12B. Examples of such materials include steel or stainless steel that have been hardened by a variety of heat treatment methods. The inner body can also be made of ceramics or carbides such as tungsten carbide. Alternatively, the inner body portion 12A and outer body portion 12B can be made of the same material.

The first pathway 14 comprises an inlet 14A at an upstream end of the dart body 12. An outlet 14B can be positioned at the outer circumference of the dart body 12. A second pathway 20 is configured to allow the cutting fluid to flow past the cutting dart 10 after the cutting fluid impinges against the inner surface of the coiled tubing 16.

A seal 22 can be positioned around a circumference of the outer body portion 12B of the dart 12. The seal 22 can be any suitable type of seal that is capable of inhibiting the flow of fluid between the dart body 12 and the coiled tubing. The seal 22 can be designed to be capable of passing through coiled tubing 16 having a plurality of different inner diameter dimensions while still providing a seal at the location where the coiled tubing 16 is to be cut. It is often the case that heavy walled tubing, having a relatively small inner diameter, and light wall pipe, having a relatively large diameter compared to the heavy walled tubing, can be employed. The heavy wall tubing is generally employed near the surface, with the light wall tubing being further downhole. In an embodiment, seal 22 comprises a plurality of flexible ribs 22A extending around the outer circumference and positioned between the end of the dart body and the outlet 14B. The ribs 22A can be made sufficiently flexible to allow the cutting dart 10 to pass through the smaller diameter of the heavy wall tubing, while still providing the desired seal in larger diameter light walled tubing. For example, the ribs 22A of seal 22 can be designed to fold over as they go through heavy walled tubing, but extend out to provide enough contact to seal in the lighter walled portion where the cutting dart 10 lands. Seal 22 can be made of any material suitable for downhole use that provides the desired flexibility and seal characteristics. An example of one such material is polyurethane.

The dart body can include a nose 24 that is configured to self-center the cutting dart 10 when landed in the coiled tubing 16. For example, the nose 24 can be tapered to provide self-centering when it contacts a tapered surface of shoulder 32C. The nose 24 is also configured to provide a desired second pathway 20 for allowing the cutting fluid to flow past the cutting dart 10. For example, as most clearly shown in FIG. 2B, the nose 24 can include a plurality of ribs 26. When the nose 24 is landed on internal shaft 32B, the ribs 26 can result in a space between the shoulder 32C and an inner surface 28 of nose 24, which provides the second pathway 20. In an embodiment, the inner surface 28 has a conical or frustoconical shape to provide the desired taper for self-centering the cutting dart 10. Centering the cutting dart 10 allows a more uniform cut of the tubing wall.

The dart body 12, including the inner body portion 12A, outer body portion 12B and nose 24 can be formed as a single, integral piece. Alternatively, dart body 12 can be formed from a plurality of different pieces bonded or otherwise connected together in any suitable manner.

The cutting dart 10 can be configured to be pumped through the coiled tubing 16 and land on a shoulder positioned in an end connector of the coiled tubing. For example, the cutting dart 10 can have a length dimension that allows it to pass through coiled tubing 16. Portions of coiled tubing 16 may be coiled around a "drum," or reel, prior to passing through an injector, which lowers the coiled tubing into the well. Coiled tubing that is wrapped around a drum can have a bend radius that is relatively small. One of ordinary skill in the art would understand that the length of the cutting dart 10 can be chosen to traverse substantially the entire length of the coiled tubing, including the portions having a small bend radius. For example, the cutting dart can have a length ranging from about 2.5 inches to about 5 inches.

The cutting dart 10 can be employed as part of a coiled tubing assembly 30. Coiled tubing assembly 30 includes a coiled tubing 16 having a proximal end 16A at a surface location and a distal end 16B positioned in a well bore. An end connector 32 can be attached to the distal end 16B of the coiled tubing 16. A tool (not shown) can be attached to the end connector 32.

Cutting dart 10 can be positioned proximate the end connector 32. In an embodiment as shown in FIG. 1, the end connector 32 can be an external connector, typically known as "grapple connectors" or "slip connectors." External connectors comprise an outer housing 32A having a grapple mechanism 34 proximate the outside surface of the distal end 16B of the coiled tubing 16. The grapple mechanism 34 can comprise, for example, teeth configured to bite into the outside of coiled tubing 16, thereby fixing the external connector to the distal end of the coiled tubing. The grapple outer diameter is tapered to engage the conically tapered inner diameter of a connector outer sleeve (not shown). Rotation of the outer sleeve engages the grapple and creates radial engagement of the grapple teeth against the outer sleeve.

An internal shaft 32B extends into the coiled tubing 16. Internal shaft 32B can be configured to provide a shoulder 32C on which the cutting dart 10 can land. For example, the shoulder 32C can be tapered to allow the cutting dart 10 to self-center in the desired location. In other embodiments, shoulder 32C can be rounded or have any other suitable shape.

In an embodiment, the internal shaft 32B can extend up above the grapple mechanism 34, but still below the upper portion of outer housing 32A, as illustrated in the embodiments of FIGS. 1 and 2. In this manner, the cutting dart 10 can be positioned to cut the coiled tubing above the grapple mechanism 34, thereby releasing the coiled tubing 16 from the grapple mechanism 34. This arrangement also positions the cutting dart 10 so that the outer housing 32A of the external connector extends over the portion of the coiled tubing 16 that will be cut. That way, the outer housing can potentially function to contain slurry and stop it from eroding the customers well, as will be described in greater detail below.

In an alternative embodiment, the end connector 32 can be an internal connector 36 (FIG. 4), which comprises an internal shaft extending into the coiled tubing 16. Internal connector 36 can be attached to the coiled tubing by mechanically crimping coiled tubing 16 so that a dimple profile 16C forms in the coiled tubing and a corresponding dimple profile 36A forms in internal connector 36. The dimple profile 16C,36A allows the internal connector 36 to grip the coiled tubing 16 so as to be fixed thereto. Internal connector 36 also includes a thread profile 36B for connecting to the top of the downhole tool 38. Shoulder 36C of the internal connector 36 can provide a landing seat for the cutting dart 10, similar to the internal shaft 32B of the external connector. In the traditional embodiment, the internal connector 36 does not employ an external housing, as in the external connector.

Figure 2A:
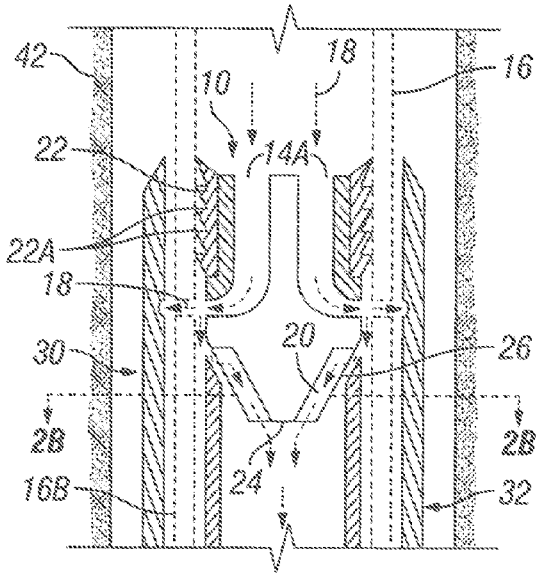
FIG. 2A illustrates the cutting dart of FIG. 1, in which cutting fluid is being pumped through the dart so that the cutting fluid is redirected radially against an inner diameter of a coiled tubing to cut the coiled tubing, according to an embodiment of the present disclosure.
Figure 2B:
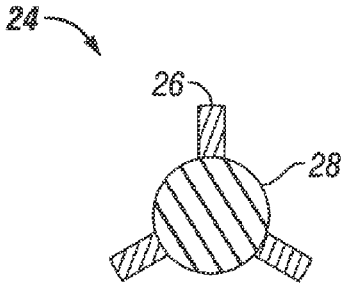
FIG. 2B illustrates a cross-sectional view of a portion of the nose of the cutting dart of FIG. 2A, according to an embodiment of the present disclosure.
Figure 4:
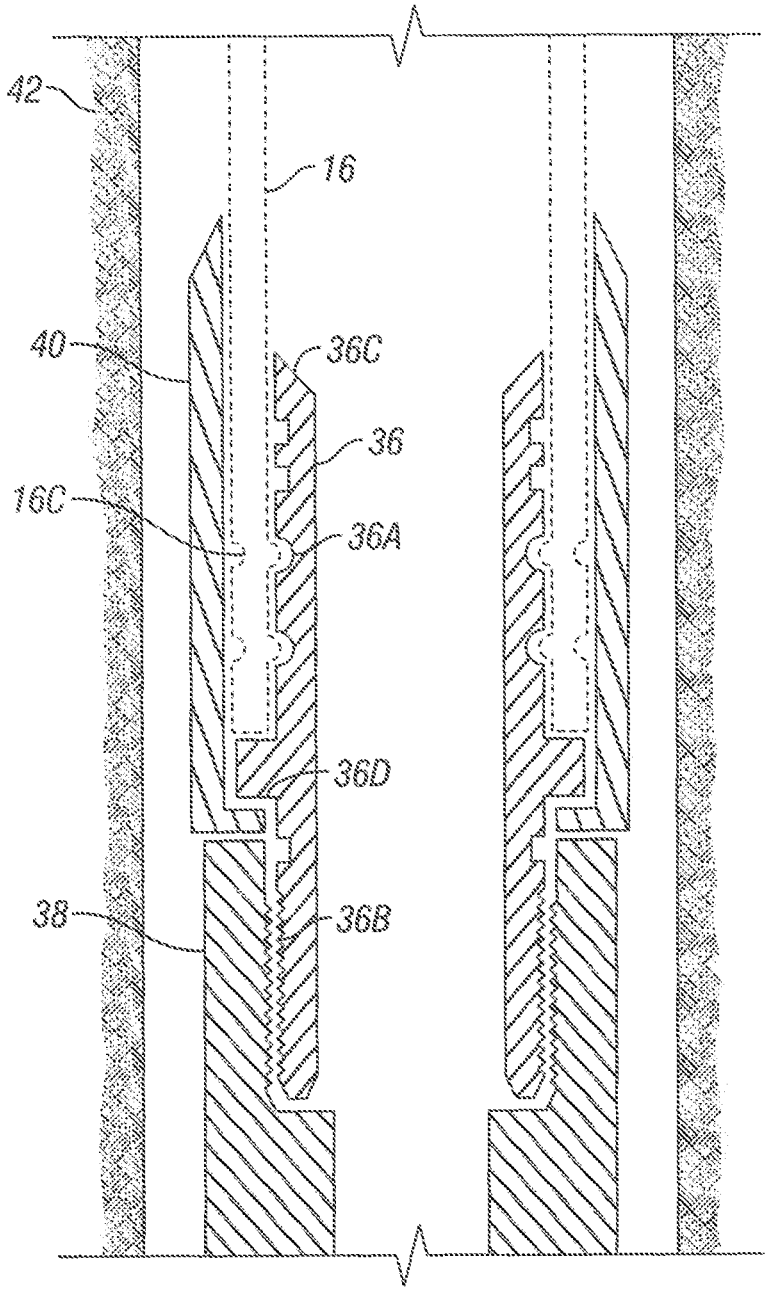
FIG. 4 illustrates an internal connector, according to an embodiment of the present disclosure.

In an alternative embodiment, the internal connector 36 can be employed with an outer sleeve 40, illustrated in FIG. 4, which is capable of protecting the well bore from being damaged by the cutting fluid when the coiled tubing is cut. Outer sleeve 40 can be positioned proximate the outside surface of the distal end of the coiled tubing between the outlet 14B of the cutting dart 10 (when positioned similarly as shown in FIG. 2A) and the well bore 42. Outer sleeve 40 can be attached in any suitable manner. For example, as shown in FIG. 4, the outer sleeve 40 can be held in place between a shoulder 36D of the internal connector 36 and a box connection of the tool 38.

Figure 5:
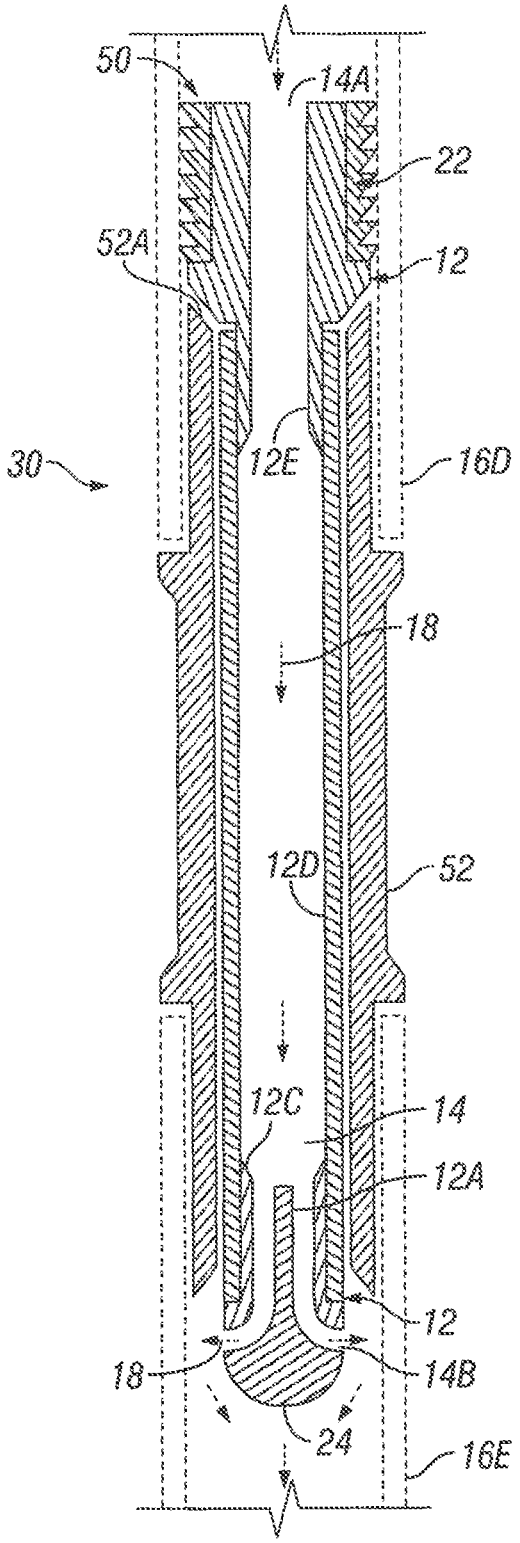
FIG. 5 illustrates a cutting dart, according to an embodiment of the present disclosure.

FIG. 5 illustrates a cutting dart 50, according to another embodiment of the present disclosure. The cutting dart 50 is designed to be employed with a coiled tubing string connector 52 that can be used to couple a first length of coiled tubing string 16D to a second length of coiled tubing string 16E. An example of one such tubing string connector 52 that is well known in the art is the DURALINK™ spoolable connector, available from BJ Services Company LLC.

Coiled tubing string connector 52 has a smaller inner diameter than the coiled tubing, and thus can potentially block passage of the dart 50, discussed above. In an embodiment, cutting dart 50 can be landed on a shoulder 52A, instead of on an end connector 32 (as shown in FIG. 1), in order to cut the first length of coiled tubing 16D above the coiled tubing string connector 52. However, it is sometimes desirable to cut the length of coiled tubing 16E below the coiled tubing string connector 52. Cutting dart 50 is designed for this purpose.

The cutting dart 50 includes a dart body 12 with a first pathway 14 positioned there through. The dart body 12 can include an inner body portion 12A and an outer body portion, similar to the cutting dart 10. However, the outer body portion of cutting dart 50 has been extended to include an outer body cutting portion 12C, a flexible tubular 12D, and an outer body sealing portion 12E. The profiles of the inner body portion 12A and outer body portion 12C,12D,12E can be shaped in any manner that will redirect the cutting fluid flow, as desired. For example, the inner body portion 12A can have a trumpet shaped profile. A seal 22, similar to that described above with respect to cutting dart 10, can be positioned around a circumference of the outer body sealing portion 12E. The nose 24 of the dart body 12 can be any desired shape, including tapered or not tapered.

As shown in FIG. 5, the cutting dart 50 is configured to land on shoulder 52A and extend through coiled tubing string connector 52, so that an outlet 14B of the pathway 14 is positioned below the coiled tubing string connector 52. The cutting dart 50 can then be used to cut the second length of tubing string 16E below the coiled tubing string connector 52.

Cutting dart 50 can have any suitable length that will allow it to extend through the coiled tubing string connector 52. For example, the cutting dart 50 can have a length ranging from about 10" to about 36". The flexible tubular 12C allows the cutting dart 50 to bend when it is passing through portions of coiled tubing 16 that may be coiled around a "drum," or reel, and that therefore have a bend radius that is relatively small. In this manner, cutting dart 50 can traverse the relatively small bend radius portions of the coiled tubing.

Figure 6:
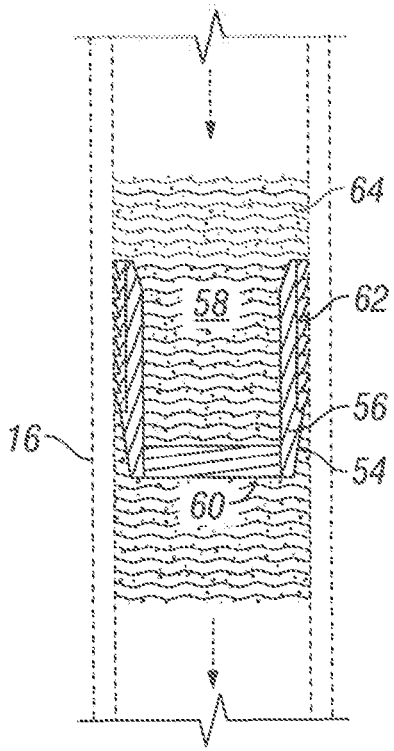
FIG. 6 illustrates an anchor dart, according to an embodiment of the present disclosure.
Figure 7:
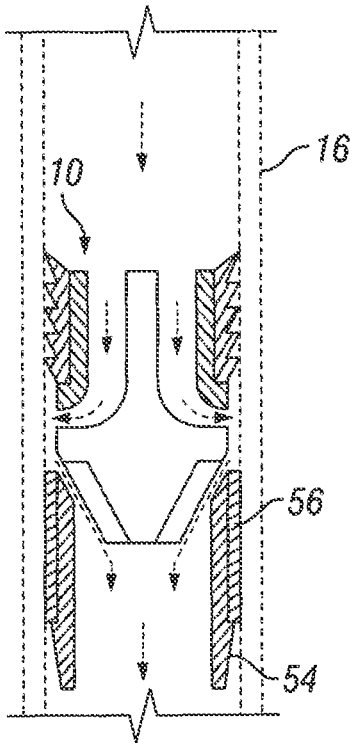
FIG. 7 illustrates an anchor dart and cutting dart arrangement, according to an embodiment of the present disclosure.

FIGS. 6 and 7 illustrate yet another embodiment of the present disclosure. FIG. 6 illustrates an anchor dart 54 that can be used along with the cutting dart 10 (FIG. 1) of the present disclosure. Anchor dart 54 can be fixed inside the coiled tubing 16 to provide a shoulder on which the cutting dart 10 can land, as shown in FIG. 7. This allows the coiled tubing 16 to be cut at any desired location at which the anchor dart 54 can be fixed.

Anchor dart 54 can comprise a dart body 56 configured to include a fluid pathway 58 positioned therein. The dart body 56 is not limited to the design illustrated in FIG. 6, and can have any suitable shape or configuration that will allow the anchor dart 54 to pass through the coiled tubing and be anchored at a desired position. For example, in cases where the anchor dart 54 is used to isolate the coiled tubing, as discussed in detail below, the dart body 56 can be formed to be a solid mass without a fluid pathway so as not to allow fluid to pass therethrough.

A blocking member, such as frangible disk 60, can be positioned to selectively inhibit the flow of fluid through the fluid pathway 58. Darts comprising a fluid pathway and a frangible disk arrangement are generally well known in the art for use in processes for pumping cement for both wellbore and formation isolation. Other suitable blocking members can be used in place of the frangible disk, including, for example, blow out plugs, such as a shear pinned plug, or valves, such as a spring loaded check valve.

The anchor dart 54 comprises a swellable elastomer 62 positioned around an outer circumference of the dart body 56. The swellable elastomer 62 can have any configuration and be positioned at any desired location on the outer circumference of the dart body 56 that will result in sufficient force applied to the coiled tubing 16 to fix the anchor dart 54 in a desired position in the coiled tubing 16 when the elastomer material swells. For example, the elastomer can be configured as a single ring or a plurality of fins or ribs.

The swellable elastomer 62 can comprise any suitable material that is capable of swelling to provide sufficient force to fix the anchor dart 54 in place while still allowing it to pass through the coiled tubing prior to swelling. Swellable elastomer materials are well known in the art. Examples of suitable elastomer materials include both natural and synthetic rubbers.

Figure 3:
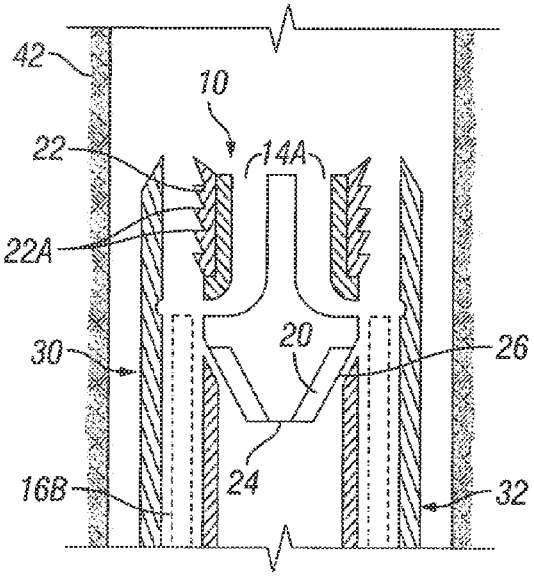
FIG. 3 illustrates the cutting dart of FIGS. 1 and 2A, in which an upper portion of the cut coiled tubing has been removed, according to an embodiment of the present disclosure.

The present disclosure is also directed to a method of cutting a coiled tubing string in a well bore. The method comprises pumping a dart through coiled tubing until it lands at a location proximate the position at which the coiled tubing is to be cut, such as, for example, an internal sleeve of end connector 32, as shown at FIG. 1. A cutting fluid can be pumped through the dart to redirect the cutting fluid radially against an inner diameter of the coiled tubing so as to cut the coiled tubing, as shown by fluid flow arrows 18 of FIG. 2A. The upper portion of the coiled tubing 16 can then be removed from the well bore 42, as shown in FIG. 3.

In an embodiment, the cutting fluid can be a slurry comprising abrasive particles. Any suitable particles can be employed, such as sand. Sand slurries are generally well known in the art for use in abrasive perforating, and one of ordinary skill in the art would be capable of choosing a suitable sand slurry or other cutting fluid. The slurry from the cutting dart 10 impacts the coiled tubing surface with sufficient force so that the abrasive particles mechanically cut through the coiled tubing.

In another embodiment, the cutting fluid can be an acid capable of dissolving the coiled tubing 16. Where an acid is employed, the cutting fluid can also include an acid inhibitor that is capable of coating the coiled tubing 16, thereby protecting the coiled tubing 16 as the acid is pumped from the surface to the cutting dart 10. Such acid and acid inhibitor systems are generally well known in the art for use with coiled tubing applications. In the present disclosure, the acid forced through the cutting dart 10 impinges against the coiled tubing surface with sufficient force to disrupt the film forming capability of the acid inhibitor, thereby allowing the acid to dissolve through the coiled tubing 16 at the desired location.

A method of employing the anchor dart 54 will now be discussed. Anchor dart 54 can be employed in situations where it is desired to cut the coiled tubing 16 at a location other than where a shoulder, such as provided by an end connector or coiled tubing string connector, already exists. For example, this may occur where the coiled tubing string is stuck and an attempt to release the coiled tubing string by cutting it at the end connector fails.

A method of using the anchor dart 54 includes inserting the anchor dart 54 into the coiled tubing at the surface. A measured volume of fluid can then be pumped down the coiled tubing 16 to displace the anchor dart 54 to a desired location inside the coiled tubing 16. In an embodiment, a swelling enhancer fluid 64 capable of accelerating swelling of the elastomer 62 can be introduced into the coiled tubing 16 with the anchor dart 54. The swelling enhancer fluid 64 can be any suitable reaction fluid or solvent that can increase the rate of swelling. Reactive fluids or solvents that can accelerate the swelling of the swellable elastomer 62 are well known in the art. The combination of chemical action of the swelling enhancer fluid 64 assisted by elevated temperatures causes the elastomer to swell and the anchor dart 54 to become rigidly affixed to the inside of the coiled tubing 16, as shown in FIG. 7. After allowing time for a desired amount of swelling, the frangible disk can be burst and circulation reestablished through coiled tubing 16.

The resulting affixed anchor dart 54 provides a shoulder within the coiled tubing 16 on which the cutting dart 10 can land, similarly as shown in FIG. 7. The coiled tubing 16 can then be cut, as described above. Employing the anchor dart to cut the coiled tubing string partway along its length addresses the issue of the coiled tubing becoming stuck by sand or fill falling down and bridging around the outside of the coiled tubing higher up the well, rather than at the end connector. This operation of fixing the anchor dart 54 and cutting the coiled tubing 16 can be repeated multiple times at different locations in the coiled tubing 16 until the remaining coiled tubing string is no longer stuck and can be retrieved to the surface.

The anchor dart 54 can also be employed to isolate the coiled tubing string. For example, after making the cut with either the cutting dart 54 or some other cutting means, a check valve proximate the end of the coiled tubing string is lost, and fluids from the wellbore can enter the coiled tubing string at the location of the cut. The coiled tubing is therefore "live" while it is being pulled from the well. Under some conditions, it may be considered too risky to retrieve the live coiled tubing string under internal well pressure.

In such situations, the anchor dart 54 can be pumped downhole to within a desired distance from where the coiled tubing string has been cut and allowed to swell and lock into place. Alternatively, if well pressures cannot be managed within the burst rating of the frangible disk, a solid anchor dart designed to handle the well pressures or a dart with a spring loaded check valve can be employed; or the anchor dart 54 can be used as a landing point for a regular dart with a higher pressure rating that can isolate the coiled tubing string after the cut. In this manner, the anchor dart 54 can be used to isolate the coiled tubing string prior to retrieving the coiled tubing 16 from the well.

In still other situations, the anchor dart 54 can be employed to isolate the coiled tubing where, for example, the coiled tubing has been punctured to form a hole therein through which hydrocarbons can leak. The method can include pumping the anchor dart 54 through the coiled tubing until it is positioned at a location at which the coiled tubing is to be isolated, such as a location proximate the hole. The swellable elastomer can then be expanded to fix the anchor dart inside the coiled tubing and thereby inhibiting the flow of fluid through the coiled tubing. In this manner, the anchor dart 54 can be fixed to isolate the hole in the coiled tubing from the portion of the coiled tubing pressurized by hydrocarbon fluid flowing from the well. In this manner, the amount of hydrocarbon fluid leaking through the hole can be reduced.

When isolating the coiled tubing, the dart body 56 can include a pathway 58 for conducting fluid, along with a blocking member for selectively inhibiting fluid flow through the pathway, as discussed above. Alternatively, the dart body can be formed as a solid mass without a pathway capable of conducting fluid therethrough.

Figure 8:
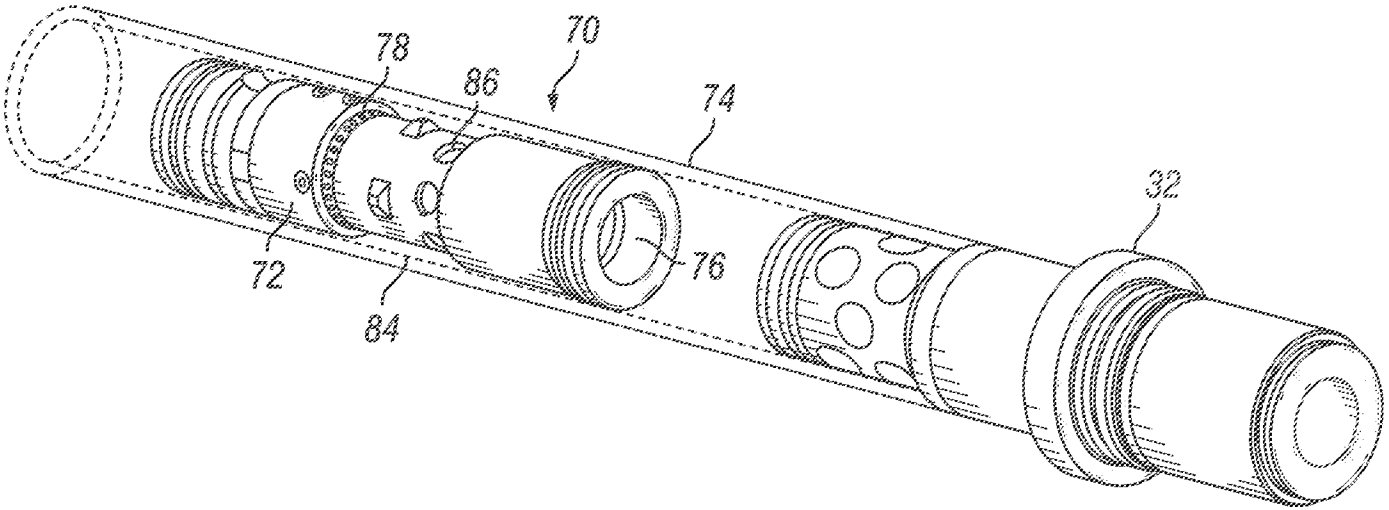
FIGS. 8 to 10 illustrate a cutting assembly, according to an embodiment of the present disclosure.
Figure 9:
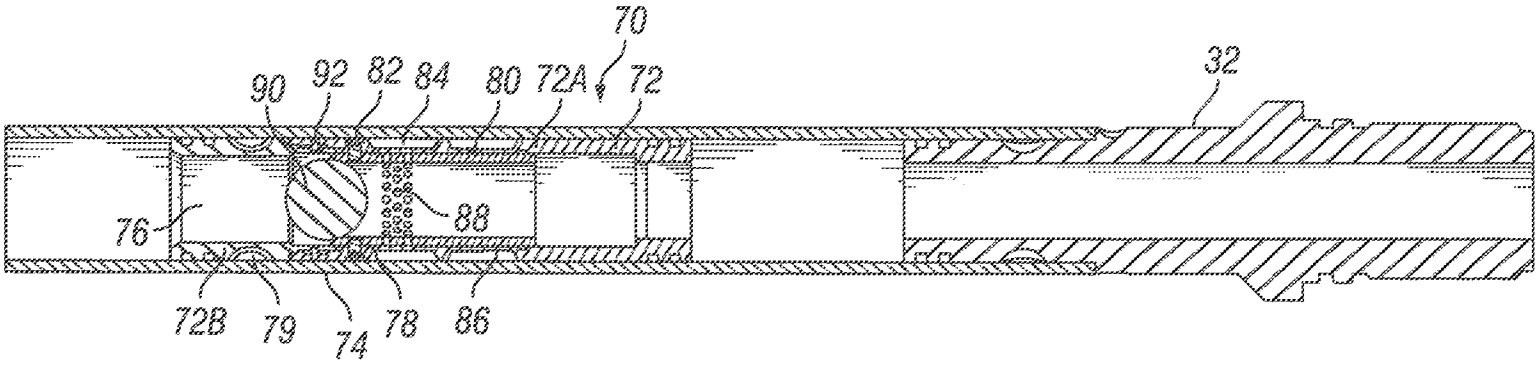
Figure 10:
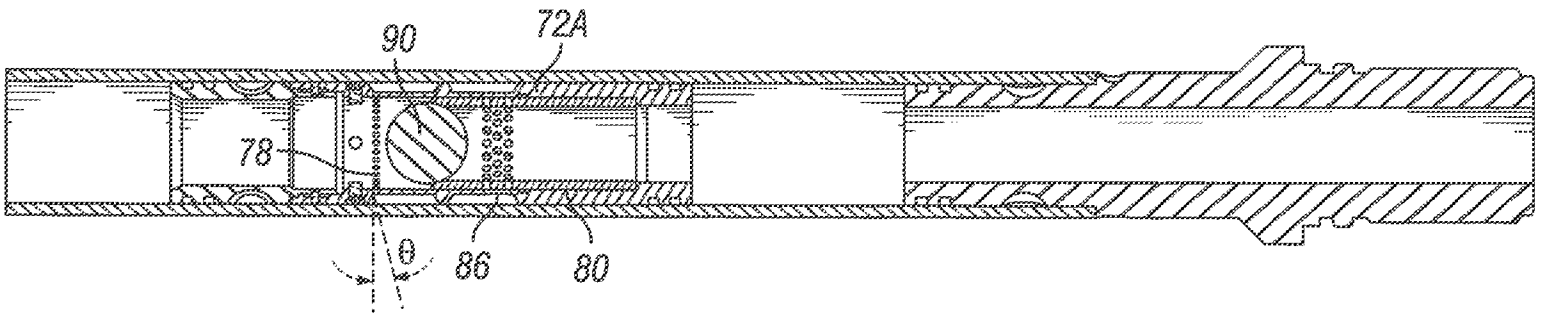

Referring to FIGS. 8 to 10, another embodiment of the present disclosure is directed to a coiled tubing cutter assembly 70. The coiled tubing cutter assembly 70 can be positioned proximate the distal end of a coiled tubing assembly and above a coiled tubing end connector 32 positioned at the distal end of coiled tubing 74. The coiled tubing cutter assembly 70 can be preinstalled in the coiled tubing 74 prior to running the coiled tubing string into the well.

After the coiled tubing with the cutter assembly 70 is run into the well, the coiled tubing cutter assembly 70 can be actuated by pumping a projectile, such as a ball, pig or dart, through the coiled tubing, as will be discussed in detail below. This can be easier than pumping the cutting darts discussed above, and may be employed in some instances where it may be difficult or impossible for the cutting darts to pass through the coiled tubing. For example, where a coiled tubing string connecter in the coiled tubing string has an inner diameter that is too small to allow a cutting dart to pass, a projectile having a sufficiently small diameter so as to pass through the coiled tubing connecter can be used to activate the preinstalled coiled tubing cutter assembly 70, thereby allowing the coiled tubing to be cut below the coiled tubing string connector.

The coiled tubing cutter assembly 70 comprises a housing 72 configured to be inserted in a length of coiled tubing 74. Housing 72 comprises a main bore 76 that allows flow from the coiled tubing to pass therethrough. Housing 72 also forms a first pathway 78, more clearly shown in FIG. 10, through which cutting fluid can flow through the sidewall of housing 72 and be directed to impinge radially against an inner surface of coiled tubing 74 over which housing 72 is positioned. In an embodiment, first pathway 78 can comprise a series of apertures, as more clearly illustrated in FIG. 10.

In order to erode the coiled tubing in a reasonable time frame, the size of the apertures in first pathway 78 can be chosen so that the cutting fluid flowing from the apertures achieves a desired jet velocity. As one of ordinary skill in the art would readily understand, the smaller the apertures generally the higher the jet velocity will be for a given cutting fluid.

The apertures can be angled to generate sufficient swirling action to achieve increased circumferential metal removal. It is thought that the swirling action spreads the abrasive in the cutting fluid over a larger area, thereby removing a greater portion of the coiled tubing wall. This can reduce the amount of overpull needed to pull the coiled tubing apart, as described in greater detail below. The apertures can be angled tangentially and/or axially. For example, the apertures can be angled tangentially at an angle (not shown) ranging from about 5 degrees to about 25 degrees, such as as about 15 degrees, and can also be angled axially at an angle, $\theta$, of about 0 to about 15 degrees, such as about 5 degrees to about 10 degrees (See FIG. 10).

All or a portion of the housing 72 can be made of a material that can withstand the cutting fluid while still being resistant to normal hydrocarbon well intervention fluids. For example, where the cutting fluid is an abrasive slurry, the material can be sufficiently hard enough to withstand the abrasive action of the slurry at least for the amount of time it will take to perform the desired cutting of the coiled tubing. Examples of suitable materials include carbides, such as tungsten carbide, ceramics and hardenable steels, which are discussed above as steels or stainless steels that have been hardened. The term "hardenable steels" refers to steels that can be machined into the desired shape and then heat treated to increase the hardness of the steel. Alternatively, the steel that is used could be hardened and then machined.

In an embodiment, housing 72 can comprise multiple parts, such as a first part 72A and a second part 72B, as shown in FIG. 9. Making the housing in two parts can allow for ease of manufacturing while also allowing for an increased internal diameter of the sleeve 80. This is because the ID of the second part 72B of the housing can be smaller than the desired OD of the sleeve 80 due to the depth of the locating dimple 79 in the second part 72B. In an alternative embodiment, such as where a smaller ID sleeve 80 is permissible, the housing can be made in a single piece.

Part 72A can be configured to direct the flow of slurry and can be made of a harder material that can withstand abrasion caused by redirecting the slurry, such as the materials discussed above. Part 72B can be made of the same material or a different material than part 72A. Because part 72B is generally not redirecting the direction of the cutting fluid, the material used can have a hardness that is less than that of part 72A. Part 72A and Part 72B can be attached in any suitable manner, such as with screws 92, or by threading the ends of parts 72A and 72B together (not shown).

As mentioned above, part 72B can include dimples 79. Dimples 79 can allow cutter assembly 70 to be independently positioned and attached to the coiled tubing at any position above the end connector. For example, if the end connector is an external grapple connector, there may be sleeves extending from the grapple connector along the outside of the coiled tubing, such as outer housing 32A of FIG. 1, discussed above. By connecting the cutter sleeve to the coiled tubing using a dimple as illustrated, the cutter assembly can be positioned above the sleeves if desired, thereby allowing the coiled tubing to be cut above the sleeves of the grapple connector. The dimples 79 also allow the cutter assembly to stay connected to an upper portion of the coiled tubing that is removed from the well after the coiled tubing is cut, thereby allowing the cutter assembly to also be removed from the well.

Alternatively, the cutter assembly 70 can be attached to the coiled tubing in any other suitable manner. In an embodiment, the housing 72 of cutter assembly 70 can be physically attached to the end connector 32. For example, where the end connector is a dimple connector, the housing 72 could attach to the end of the end connector using threads (not shown) or any other suitable connecting means.

A sleeve 80 is positioned inside main bore 76 of housing 72. Sleeve 80 is movable between a first position, as shown in FIG. 9, and a second position, as shown in FIG. 10. Sleeve 80 can be held in the first position using any suitable means, such as shear pins 82, until it is desired to move the sleeve to the second position. In the first position, the sleeve is configured to block the first pathway 78. When the sleeve 80 is moved to the second position, cutting fluid is allowed to pass through the first pathway 78.

Housing 72 can further be configured to form an annulus 84 between coiled tubing 74 and housing 72. Cutting fluid passing through first pathway 78 can flow through the annulus 84 and through a second pathway 86 back into the main bore of the housing after impinging against the inner surface of the coiled tubing. In an embodiment, second pathway 86 can comprise a series of apertures in the housing, as shown more clearly in FIG. 8. Any other suitable flow configuration that allows the cutting fluid to escape from the housing and flow on down through the coiled tubing during the cutting process could be employed instead of the flow arrangement illustrated.

In order to allow fluid communication between annulus 84 and main bore 76 through the second pathway 86, sleeve 80 can also comprise a plurality of apertures 88. Sleeve 80 can be designed so that at least some of the apertures 88 axially align with the second pathway 86 when the sleeve is in the second position, without the need for rotational alignment of the apertures 88 with the second pathway 86. This can be accomplished by, for example, employing a plurality of smaller apertures around the entire circumference of sleeve 80. Other aperture configurations for sleeve 80 can also be employed, including using larger apertures that can be aligned with the apertures of the second pathway 86.

Sleeve 80 can be configured so that a projectile 90 can land thereon, as shown in FIG. 9. While projectile 90 is illustrated as a ball, any other suitable projectile, such as a pig or dart, could be employed instead. The projectile 90 blocks fluid from flowing through the main bore 76. The coiled tubing 74 can then be pressured up to apply sufficient force to projectile 90 to shear the shear pins 82 and move the sleeve 80 to the second position, at which point the projectile 90 is positioned in the main bore 76 between the first pathway 78 and the second pathway 86, as shown in FIG. 10.

As previously discussed above with respect to the cutting dart 10, the present application is also directed to methods of cutting a coiled tubing string in a well bore using fluids. In general, the methods of the present disclosure involve a cutter assembly proximate the position at which the coiled tubing is to be cut. The cutter assembly can be any suitable device, such as the cutting darts or other cutting assemblies discussed herein, that can be used to direct cutting fluid so that it impinges radially against the coiled tubing, thereby allowing the coiled tubing to be cut. This allows the portion of the coiled tubing above the cut to be retrieved from the well bore. The stuck portion of the coiled tubing below the cut can then be removed later using other techniques. Techniques for removing tools that are stuck in wells are well known in the art.

The methods of the present application can comprise establishing an open flowpath proximate a desired cut site for directing cutting fluid radially against an inner diameter of the coiled tubing. The open flowpath can be established in any suitable manner, including by deploying any of the cutting darts discussed herein, or by opening the flowpath of a preinstalled cutting assembly, as will now be discussed in more detail.

In an embodiment, the coiled tubing string can comprise a cutter assembly 70 installed within the coiled tubing 74, as illustrated in FIG. 8. The cutting assembly can be preinstalled proximate the position at which the coiled tubing 74 is to be cut prior to running the coiled tubing 74 into the well, as discussed above. The internal coiled tubing seam weld can be removed prior to installing the cutter assembly 70.

In order to establish an open flowpath for cutting the coiled tubing 74 using cutter assembly 70, a projectile 90 can be pumped down into the well through the coiled tubing 74. The projectile is small enough so that it can pass through the coiled tubing until it lands on sleeve 80 of the cutter assembly 70, thereby blocking fluid flow through main bore 76 of the housing 72.

The coiled tubing can then be pressurized until sufficient pressure is applied to the projectile 90 to move the sleeve 80 from the first position, as shown in FIG. 9, to the second position, as shown in FIG. 10. In this manner, an open pathway through the housing is established. The sequence of these events can be verified, for example, by pressure responses at the surface.

Any suitable pathway that directs the cutting fluid radially against the coiled tubing can be employed. For example, the open flowpath can comprise first pathway 78, annulus 84 and second pathway 86, as discussed above for the cutter assembly 70. In an embodiment where cutter assembly 70 is employed, the projectile 90 is positioned in the main bore below the first pathway 78 and above the second pathway 86 when the sleeve 80 moves to the second position, as shown in FIG. 10.

Cutting fluid can then be pumped through the cutter assembly 70. Any suitable cutting fluid can be employed with the cutter assembly 70. For example, any of the cutting fluids discussed herein above can be used. Referring to FIG. 10, cutting fluid flowing down coiled tubing 74 is forced through first pathway 78 due to the blockage of the main bore by projectile 90. After being accelerated against the inner surface of coiled tubing 74, the cutting fluid flows through annulus 84 and second pathway 86 and back into the main bore 76, where it can then flow through coiled tubing end connector 32 and out into the well.

As the cutting fluid flowing from the first pathway 78 is accelerated against an inner surface of the coiled tubing 74, the cutting fluid can physically and/or chemically remove material from the coiled tubing wall at the point of impact. In an embodiment, the cutting fluid flow may continue until the coiled tubing 74 is cut entirely in two. Alternatively, the coiled tubing can be partially cut until sufficient material is removed to allow an adequate force to be applied to the coiled tubing so that the coiled tubing will pull apart at the cut site. After the coiled tubing is pulled apart or is cut in two using the cutting fluid, the coiled tubing above the cut can then be retrieved from the well bore. If desired, circulation through the coiled tubing can be maintained once the projectile 90 has landed and the coiled tubing has been cut.

In embodiments where the coiled tubing is partially cut and then a force is applied to pull the coiled tubing apart at the cut, the force can be applied by any suitable means. For example, the force can be applied by pulling up on the stuck coiled tubing using equipment at the surface, as would be readily understood by one of ordinary skill in the art. Any suitable amount of force can be used, such as, for example, about 2000 pounds to about 30,000 pounds of force, where the force is measured as the amount of pull exerted by the coiled tubing injector.

EXAMPLE

Figure 11:
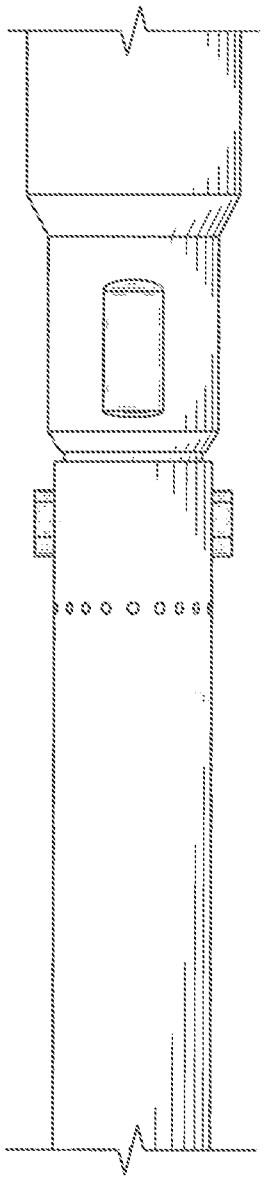
FIGS. 11 and 12 illustrate the results of a test for cutting coiled tubing using a sand slurry and then pulling the coiled tubing apart, according to principles of the present disclosure.
Figure 12:
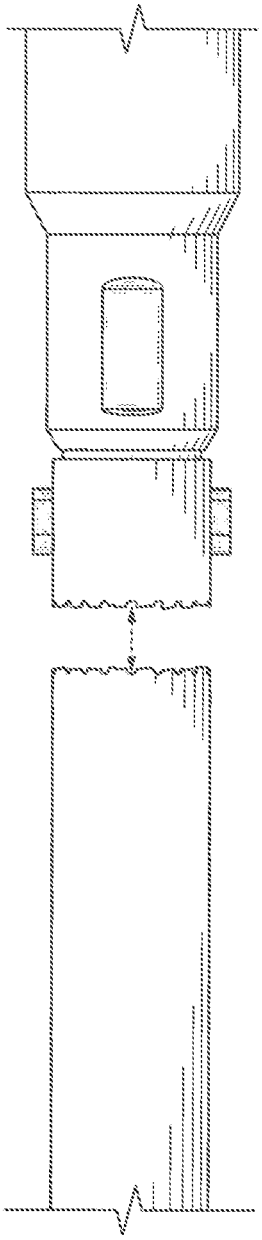

Testing was performed in which a 2 inch diameter coiled tubing with 0.156 inch walls was partially cut using an abrasive cutting fluid directed through apertures in a pipe positioned inside the coiled tubing. The fluid was pumped for approximately 5 minutes. The results are shown in FIG. 11. The coiled tubing was then pulled apart using 15,000 to 20,000 pounds of force. The resulting pulled apart coiled tubing is shown in 12. As shown, a relatively clean break was made at the cut site, which can allow a well tool to more easily attach to and remove the stuck part of the coiled tubing remaining in the well.

Although various embodiments have been shown and described, the present disclosure is not so limited and will be understood to include all such modifications and variations as would be apparent to one skilled in the art.

What is claimed is:

1. A coiled tubing cutter assembly, comprising:

a housing attached to a length of coiled tubing, the housing forming a main bore and a first pathway through which cutting fluid can flow through the housing and be directed to impinge against an inner surface of the coded tubing over which the housing is positioned so as to cut the coiled tubing; and a sleeve positioned in the main bore, the sleeve being movable between a first position and a second position within the main bore, the sleeve being configured so as to block the first pathway when in the first position and to allow cutting fluid to pass through the first pathway in the second position.

2. The cutter assembly of claim 1, wherein the sleeve is further configured so that a projectile pumped through the coiled tubing can land on the sleeve, thereby blocking fluid flow through the main bore of the housing.

3. The cutter assembly of claim 2, further comprising a second pathway between the housing and the coil tubing through which cutting fluid can be directed to flow back into the main bore of the housing after impinging against the inner surface of the coiled tubing.

4. The cutter assembly of claim 3, wherein the sleeve is configured so that a projectile landed on the sleeve is positioned in the main bore between the first pathway and the second pathway when the sleeve is in the second position.

5. The cutter assembly of claim 1, wherein the first pathway comprises a first set of apertures through the housing and the second pathway comprises a second set of apertures through the housing, the housing being configured to provide an annulus for providing fluid communication between the first set of apertures and the second set of apertures.

6. The cutter assembly of claim 1, wherein the sleeve comprises a plurality of apertures that allow fluid communication between the second pathway and the main bore when the sleeve is in the second position.

7. The cutter assembly of claim 1, wherein the sleeve is held in the first position using one or more shearable device.

8. A method of cutting a coiled tubing in a well bore, the method comprising:

establishing, at a cutter assembly attached to a coiled tubing, an open flowpath proximate a desired cut site for directing cutting fluid against an inner surface of the coiled tubing;

pumping cutting fluid through the open flowpath so that the cutting fluid impinges against the cut site so as to cut the coiled tubing; and retrieving a first portion of coiled tubing above the cut site from the well bore while a second portion of the coiled tubing below the cut site remains in the well;

wherein the cutter assembly is installed within the coiled tubing proximate the cut site, and further wherein establishing an open flowpath comprises:

pumping a projectile through the coiled tubing so that the projectile lands on a sleeve of the cutter assembly, the sleeve being in a first position; and applying sufficient force to the projectile in the coiled tubing so as to move the sleeve to a second position, thereby establishing a first fluid pathway through a housing.

9. The method of claim 8, wherein the projectile blocks fluid flow through a main bore of the housing after the projectile lands on the sleeve.

10. The method of claim 9, wherein when the sleeve moves to the second position, the projectile is positioned in the main bore below the first fluid pathway.

11. The method of claim 9, wherein the cutting fluid flows back into the main bore of the housing after impinging against the inner surface of the coiled tubing.

12. The method of claim 8, wherein the cutting fluid is a slurry.

13. The method of claim 8, wherein the coiled tubing is partially cut by pumping the cutting fluid, the method further comprising applying a force to the coiled tubing to break the coiled tubing after pumping the cutting fluid.

14. A coiled tubing assembly, comprising:

a length of coiled tubing positioned in a well bore; and a coiled tubing cutter assembly attached to the coiled tubing, the cutter assembly comprising:

a housing attached to the coiled tubing, the housing forming a main bore and a first pathway through which cutting fluid can flow through the housing and be directed to impinge against an inner surface of the coiled tubing so as to cut the coiled tubing; and a sleeve positioned in the main bore, the sleeve being movable between a first position and a second position within the main bore, the sleeve being configured so as to block the first pathway when in the first position and to allow cutting fluid to pass through the first pathway when in the second position.

15. The coiled tubing assembly of claim 14, wherein the sleeve is further configured so that a projectile pumped through the coiled tubing can land on the sleeve, thereby blocking fluid flow through the main bore of the housing.

16. The coiled tubing assembly of claim 14, further comprising a second pathway through which cutting fluid can be directed so as to flow back into the main bore of the housing after impinging against the inner surface of the coiled tubing.

17. The coiled tubing assembly of claim 16, wherein the first pathway comprises a first set of apertures through the housing and the second pathway comprises a second set of apertures through the housing, the housing being configured to provide an annulus between the coiled tubing and the housing, the annulus provides fluid communication between the first set of apertures and the second set of apertures, and further wherein the sleeve comprises a plurality of apertures that allow fluid communication between the second pathway and the main bore when the sleeve is in the second position.

18. The coiled tubing assembly of claim 14, wherein the coiled tubing cutter assembly is positioned proximate the distal end of the coiled tubing and above a coiled tubing end connector attached to the coiled tubing.

19. A method of cutting a coiled tubing in a well bore, the method comprising:

establishing, at a cutter assembly attached to a coiled tubing, an open flowpath proximate a desired cut site for directing cutting fluid against an inner surface of the coiled tubing;

pumping cutting fluid through the open flowpath so that the cutting fluid impinges against the cut site so as to cut the coiled tubing; and retrieving a first portion of coiled tubing above the cut site from the well bore while a second portion of the coiled tubing below the cut site remains in the well;

wherein the cutting fluid comprises an acid and an acid inhibitor.

* * * * *

UNITED STATES PATENT AND TRADEMARK OFFICE

CERTIFICATE OF CORRECTION

PATENT NO. : 8,936,088 B2
APPLICATION NO. : 13/247757
DATED : January 20, 2015
INVENTOR(S) : John Misselbrook et al.

It is certified that error appears in the above-identified patent and that said Letters Patent is hereby corrected as shown below:

In the Claims

Column 13, Claim 1, Line 55-67, should read as follows:

-- 1. A coiled tubing cutter assembly, comprising:
a housing attached to a length of coiled tubing, the housing forming a main bore and a first pathway through which cutting fluid can flow through the housing and be directed to impinge against an inner surface of the coiled tubing over which the housing is positioned so as to cut the coiled tubing; and
a sleeve positioned in the main bore, the sleeve being movable between a first position and a second position within the main bore, the sleeve being configured so as to block the first pathway when in the first position and to allow cutting fluid to pass through the first pathway in the second position. --.

Signed and Sealed this
Fifth Day of May, 2015

Michelle K. Lee

Michelle K. Lee
*Director of the United States Patent and Trademark Office*